US006094015A

United States Patent [19]

Wessels et al.

[11] Patent Number: 6,094,015

[45] Date of Patent: Jul. 25, 2000

[54] ILLUMINATION UNIT AND LIQUID CRYSTAL DISPLAY DEVICE

[75] Inventors: Johannes H. Wessels; Johannes H. G. Op Het Veld, both of Eindhoven, Netherlands

[73] Assignee: U.S. Philips Corporation, New York, N.Y.

[21] Appl. No.: 09/183,382

[22] Filed: Oct. 30, 1998

[30] Foreign Application Priority Data

Nov. 7, 1997 [EP] European Pat. Off. ..... 97203461

[51] Int. Cl.[7] ..... G05F 1/00

[52] U.S. Cl. ..... 315/291; 315/246; 315/257; 315/344; 315/DIG. 1

[58] Field of Search ..... 31/246, 254, 291, 31/DIG. 1, 288, 169.3, 169.4, 257, 248, 334, 344; 313/493, 634

[56] References Cited

U.S. PATENT DOCUMENTS

| | | | |
|---|---|---|---|
| 4,748,383 | 5/1988 | Houkes | 315/248 |
| 4,751,434 | 6/1988 | Helling et al. | 315/183 |
| 5,041,762 | 8/1991 | Hartai | 315/169.3 |
| 5,070,273 | 12/1991 | Van den Bogert et al. | 313/607 |
| 5,089,943 | 2/1992 | Wolfelschneider | 362/216 |
| 5,220,249 | 6/1993 | Tsukada | 315/246 |
| 5,325,024 | 6/1994 | Piejak et al. | 315/248 |

FOREIGN PATENT DOCUMENTS 155876 7/1982 Germany .

*Primary Examiner*—Haissa Philogene
*Attorney, Agent, or Firm*—F. Brice Faller

[57] ABSTRACT

An illumination unit comprises a high-frequency supply (1) and a low-pressure discharge lamp (2). The high-frequency supply (1) is provided with a first and a second output (13*a*, 13*b*). The outputs each deliver a HF-varying voltage with respect to ground. The voltages have the same magnitude and are in phase opposition. The supply (1) is provided with a further output (13*c*) which is substantially free of high-frequency voltage variations with respect to ground. The low-pressure discharge lamp (2) is provided with a tubular discharge vessel (20) with an ionizable filling. The discharge vessel comprises a first and a second external electrode (23*a*, 23*b*), which are arranged at opposite ends (24*a*, 24*b*, respectively) of the discharge vessel and which are connected to the first and the second output (13*a*, 13*b*) of the supply (1) and a further external electrode (23*c*) which is arranged centrally between the ends (24*a*, 24*b*) of the discharge vessel (20), said external electrode being connected to the further output (13*c*) of the supply (1). The measure results in a more uniform brightness distribution of the discharge vessel (20).

8 Claims, 3 Drawing Sheets

ILLUMINATION UNIT AND LIQUID CRYSTAL DISPLAY DEVICE

BACKGROUND OF THE INVENTION

The invention relates to an illumination unit, comprising:

a high-frequency supply having a first and a second output for supplying a high-frequency varying voltage relative to ground, said voltages having the same magnitude and being in phase opposition, said high-frequency supply being provided with a further output which is substantially free of high-frequency voltage variations relative to ground; and a low-pressure discharge lamp having a tubular discharge vessel with an ionizable filling, which discharge vessel comprises a first and a second external electrode, which are arranged at opposite ends of the discharge vessel and which are connected to, respectively, the first and the second output of the supply.

The invention also relates to a liquid crystal display device comprising such an illumination unit.

Such an illumination unit is disclosed in "Frequency Dependence of RF-Driven Subminiature Fluorescent Lamps", Alexandrovich et al., J. of the Ill. Eng. Soc., Winter 1996, pp. 93–99. The lamp described in this document is a low-pressure mercury discharge lamp having a length of 20 cm and an internal diameter of 5.2 mm. A supply having a first and a second output terminal whose voltages have the same magnitude and are in phase opposition, will hereinafter also be referred to as a symmetrical supply. By using a symmetrical supply, interference is counteracted. Such illumination units are widely used as a backlight in liquid crystal display devices. Since the lamp is operated by means of external electrodes, a long service life can be achieved. A sufficiently efficient operation of such lamps requires, however, a high operating frequency, for example, of the order of one MHz and higher. In the known illumination unit, the operating frequency is 13.56, 27.12 or 40.68 MHz. It has been found that at high operating frequencies, deviations from a uniform brightness distribution readily occur as a result of parasitic capacitances between the discharge vessel and neighboring conductors. However, for applications in a display device, a uniform brightness distribution across the discharge vessel is very important.

SUMMARY OF THE INVENTION

It is an object of the invention to provide an illumination unit which has a more uniform brightness distribution across the discharge vessel. In accordance with the invention, the discharge vessel of the low-pressure discharge lamp comprises a further external electrode which is centrally arranged between the ends of the discharge vessel and which is connected to the further output of the supply.

By virtue of the presence of the further external electrode, a much more uniform brightness distribution is achieved. This is surprising, since one would expect that, centrally between its ends, the symmetrical-supply operated discharge vessel already is at a potential which is free of high-frequency voltage variations relative to ground.

U.S. Pat. No. 5,325,024 describes an illumination unit which is provided with a lamp having external electrodes and with a high-frequency supply having a first and a second output, which each supply a high-frequency varying voltage, the voltages having the same magnitude and being in phase opposition. The supply also includes a further output which is grounded and hence is free of high-frequency voltage variations relative to ground. Various pairs of lamps are connected to the supply, each pair including a first lamp whose external electrodes are connected to the first and the further output, and a second lamp whose external electrodes are connected to the second and the further output. In the illumination unit of U.S. Pat. No. 5,325,024, there is a risk that the lamps exhibit differences in brightness caused by manufacturing tolerances.

It is further noted that DD 155 876 discloses an illumination unit comprising a supply and a low-pressure discharge lamp. The supply of this illumination unit has a first output which supplies a high-frequency varying voltage relative to ground, and a further output which is grounded and hence free of high-frequency voltage variations relative to ground. Various external electrodes are connected to each of the outputs. The external electrodes connected to the first output are arranged between the electrodes connected to the further output. The supply of the illumination unit does not have a second output which supplies a voltage which is of the same magnitude as, and opposite in phase to, the voltage of the first output. As a result, the low-pressure discharge lamp of DD 155 876 is operated asymmetrically, which leads to electromagnetic interference.

In accordance with an attractive embodiment of the illumination unit the supply is provided with a high-frequency supply source and a transformer having a primary winding and a secondary winding, the primary winding of the transformer being connected to the high-frequency supply source, the first and the second output each being connected to an end of the secondary winding, and the further output being connected to a center tap of the secondary winding. This embodiment has the advantage that the supply source itself does not have to supply a symmetrical voltage and hence can be of a relatively simple construction. In this embodiment, use is made, for example, of a supply source as described in U.S. Pat. No. 4,748,383, in which the primary winding of the transformer takes the place of the coil of the electroless lamp. The supply source of U.S. Pat. No. 4,748,383, has an ac/dc converter formed by a diode bridge, and a dc/ac converter formed by a half-bridge circuit with FETs as switching elements. The center tap of the secondary winding of the transformer may be grounded, but may alternatively be connected to one of the conductors of the mains, or may be floating. In another embodiment, a full-bridge circuit is used as the dc/ac converter. In yet another embodiment, the dc/ac converter is embodied so as to be a push-pull converter. In these embodiments, the use of a transformer is superfluous.

By virtue of its uniform brightness distribution, the low-pressure discharge lamp of the illumination unit in accordance with the invention is particularly suitable for use in a display device. Therefore, the invention also relates to a liquid crystal display device, in which the liquid crystal display device is provided with an illumination unit which comprises:

a high-frequency supply having a first and a second output for supplying a high frequency varying voltage relative to ground, the voltages having the same magnitude and being in phase opposition, the high-frequency supply being provided with a further output which is substantially free of high-frequency voltage variations relative to ground; and a low-pressure discharge lamp, having a tubular discharge vessel with an ionizable filling, which discharge vessel comprises a first and a second external electrode, which are arranged on either side of the discharge vessel and which are connected to, respectively, the first and the second output of the supply;

the discharge vessel of the low-pressure discharge lamp comprising a further external electrode which is centrally arranged between the ends of the discharge vessel and which is connected to the further output of the supply.

For this application, it is attractive if the ionizable filling of the discharge vessel of the low-pressure discharge lamp comprises mercury and if the discharge vessel is provided with a luminescent layer at its inner surface. In this embodiment, the low-pressure discharge lamp of the illumination unit has a high light efficiency and the spectral characteristic of the light generated can be readily adapted by means of the composition of the luminescent layer.

The discharge vessel may be embodied so as to be, for example, planar, or bent, for example spirally bent. For use in a display device, the discharge vessel is preferably bent so as to meander in a plane. A discharge vessel bent into such a shape can be readily manufactured. A uniform illumination of the display device can be readily achieved in this embodiment.

DETAILED DESCRIPTION OF THE PREFERRED EMBODIMENTS

Figure 1:
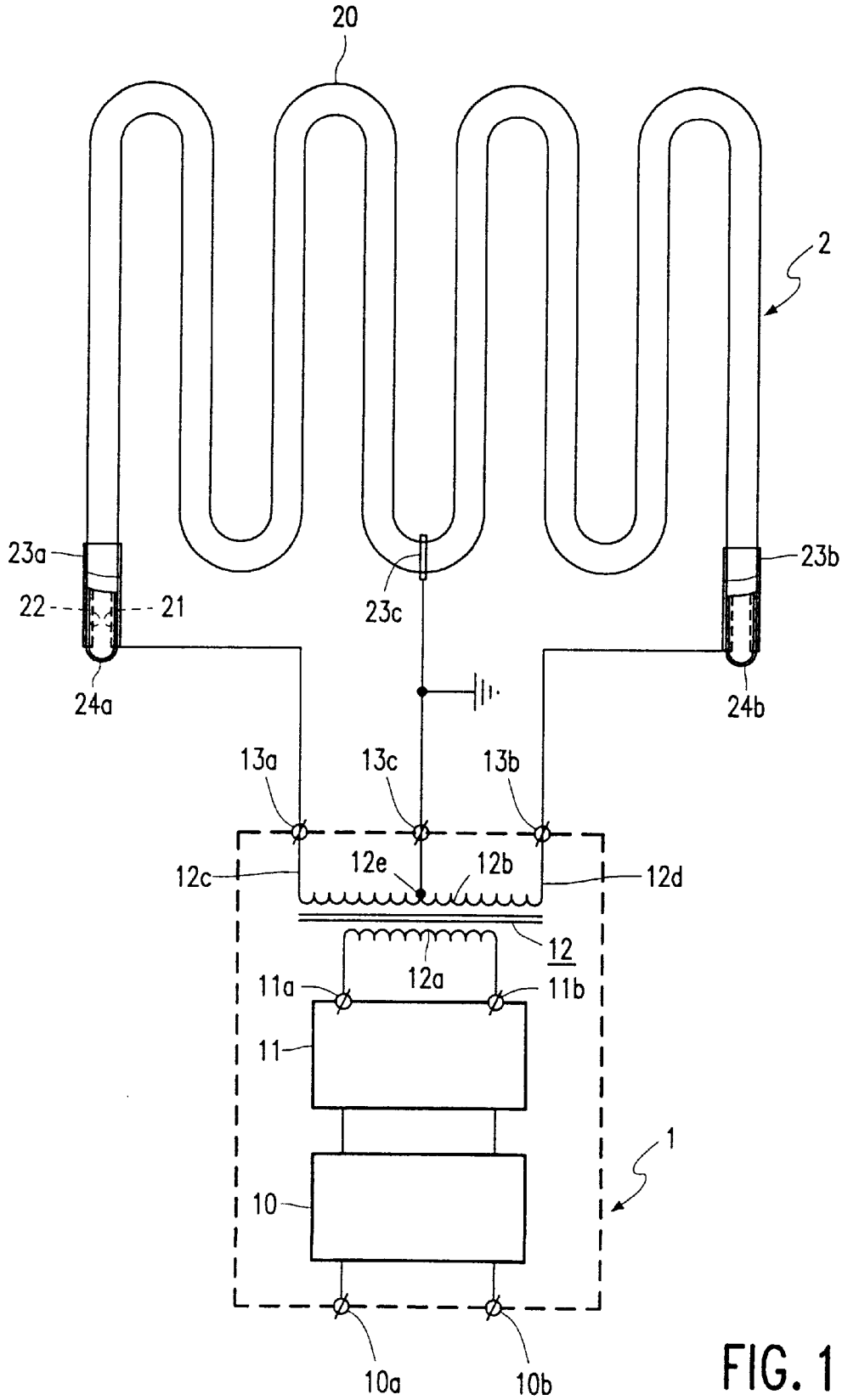
FIGS. 1, 2 and 3 successively show schematic representations of a first, second and third embodiment of the illumination unit in accordance with the invention, and FIG. 4 schematically shows a liquid crystal display device provided with an illumination unit in accordance with the invention.

FIG. 1 shows an illumination unit which comprises a high-frequency supply 1 and a low-pressure discharge lamp 2. The high-frequency supply 1 is provided with an ac/dc converter 10, a dc/ac converter 11 and a transformer 12. The ac/dc converter is provided with input terminals 10*a*, 10*b* for connection to the mains. The dc/ac converter 11 is formed by a half-bridge circuit and has output terminals 11*a*, 11*b* to which a primary winding 12*a* of the transformer is connected. The transformer has a secondary winding with ends 12*c*, 12*d* and a center tap 12*e*. The ends 12*c*, 12*d* are successively connected to a first output 13*a* and a second output 13*b* of the supply 1. The center tap 12*e* is connected to a further output 13*c*. The first and the second output 13*a*, 13*b* each supply a voltage with a frequency of 2.65 MHz. The voltages supplied have the same magnitude, in this case an amplitude of 300 V, and are in phase opposition. The further output 13*c* is grounded and hence substantially free of high-frequency voltage variations relative to ground.

The lamp 2 has a tubular discharge vessel 20 with a length of 114 cm, an internal diameter of 5 mm and a wall thickness of 0.9 mm. The inner surface 21 of discharge vessel 20 is coated with a luminescent layer 22 which is composed of a mixture of blue-luminescent barium magnesium aluminate activated with bivalent europium, green-luminescent cerium magnesium aluminate activated with trivalent terbium and red-luminescent yttrium oxide activated with trivalent europium. The discharge vessel 20 is provided with an ionizable filling formed by argon with a filling pressure of 8 mbar and 5 mg mercury. In another embodiment, a luminescent layer is absent, and the ionizable filling of the discharge vessel comprises exclusively an inert gas, for example one or more noble gases. The discharge vessel 20 is provided with a first and a second external electrode 23*a*, 23*b*, respectively, which are arranged on either side 24*a*, 24*b*, respectively, of the discharge vessel and which are connected to, respectively, the first and second output 13*a*, 13*b* of the supply 1. In this case, the first and second electrodes 23*a*, 23*b* are cylindrical collars of copper foil having a length of 15 mm.

The discharge vessel 20 of the lamp comprises a further external electrode 23*c* which is centrally arranged between the ends 24*a*, 24*b* of the discharge vessel and which is connected to the further output 13*c* of the supply 1. This further external electrode 23*c* is embodied so as to be a ring having a width of 1 mm, and is also made of copper foil.

During nominal operation, the power consumption of the lamp was 17 W. The lamp demonstrated a uniform brightness distribution.

For comparison, an illumination unit not in accordance with the invention was manufactured, which differs from the illumination unit in accordance with the invention in that a further external electrode is absent. The illumination unit not in accordance with the invention demonstrated clearly visible brightness differences throughout its length.

Figure 2:
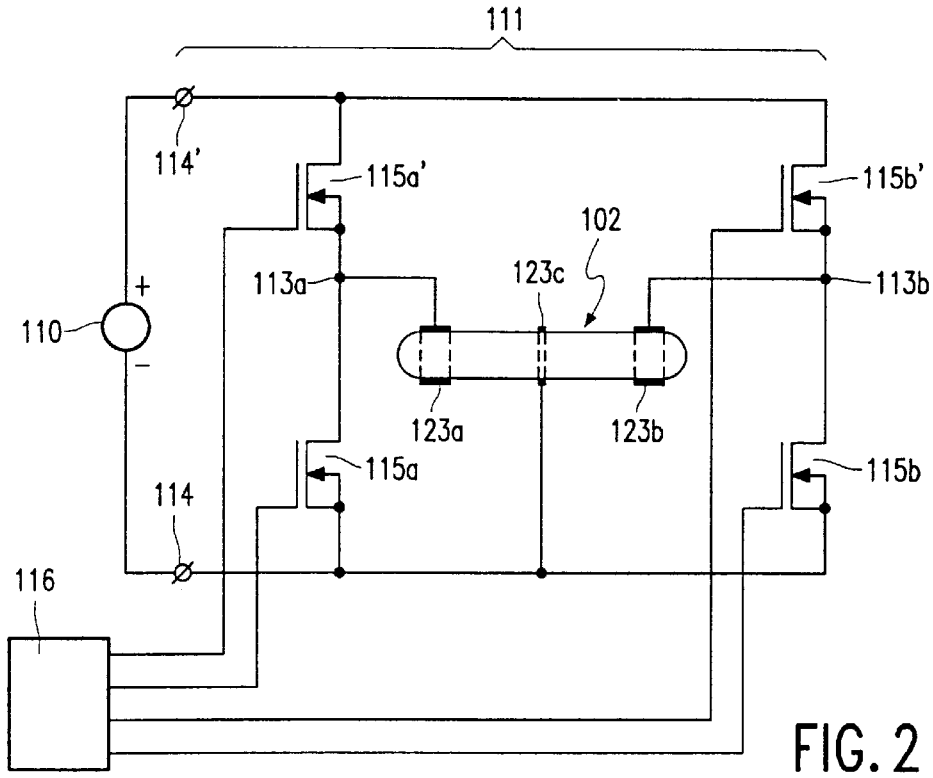

A second embodiment of the illumination unit in accordance with the invention is shown in FIG. 2. In FIG. 2, parts corresponding to parts in FIG. 1 have a reference numeral which is 100 higher. In the illumination unit shown in FIG. 2, the supply is provided with a dc/ac converter 111 which is a full-bridge circuit. having input terminals 114, 114' which are connected to a direct current source 110, for example the outputs of an ac/dc converter. The input terminals 114, 114' are interconnected via a first and a second series connection. The first series connection includes a first and a second switching element 115*a*, 115*a*'. The second series connection also includes a first and a second switching element 115*b*, 115*b*'. The first output is formed by a common point 113*a* of the switching elements 115*a*, 115*a*' in the first series connection. The second output is formed by a common point 113*b* of the switching elements 115*b*, 115*b*' in the second series connection. In the embodiment shown, one of the input terminals of the full-bridge circuit, in this case the input terminal 114 having a negative polarity, serves as the further output 113*c*. The further output 113*c* is at a constant potential and hence free of high-frequency voltage variations relative to ground. The four switching elements 115*a*, 115*a*', 115*b*, 115*b*' are controlled by control means 116. On the one hand, simultaneously, the first switching element 115*a* of the first series connection and the second switching element 115*b*' of the second series connection, and, on the other hand, simultaneously the second switching element 115*a*' of the first series connection and the first switching element 115*b* of the second series connection are alternately rendered conductive by the control unit 116.

Figure 3:
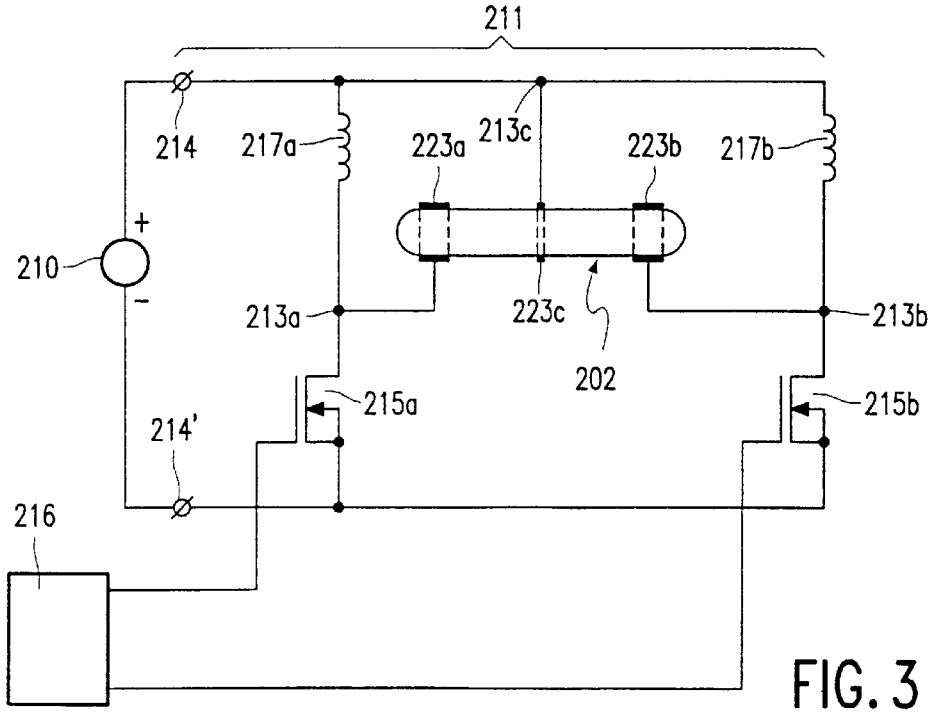

A third embodiment of the illumination unit in accordance with the invention is shown in FIG. 3. In FIG. 3, parts corresponding to parts in FIG. 1 have a reference numeral which is 200 higher, and parts corresponding to parts of FIG. 2 have a reference numeral which is 100 higher. In the illumination unit shown in FIG. 3, the supply comprises a dc/ac converter 211 which is embodied so as to be a push-pull converter. As in the embodiment shown in FIG. 2, input terminals 214, 214', which are connected to a direct-current source 210, are bridged by a first and a second series connection, in this case a coil and a switching element. The first series connection includes a coil 217*a* and a switching element 215*a*, the second series connection includes a coil 217*b* and a switching element 215*b*. The first output 213*a* is formed by a common point of the coil 217*a* and the switching element 215*a* in the first series connection. A common point of the coil 217*b* and the switching element

215*b* in the second series connection forms the second output 213*b*. The further output 213*c* is formed by one of the input terminals of the DC/AC converter, in this case the input terminal 214 with a positive polarity. The further output 213*c* is free of high-frequency voltage variations relative to ground. The switching elements 215*a*, 215*b* are alternately rendered conductive by the control unit 216.

Figure 4:
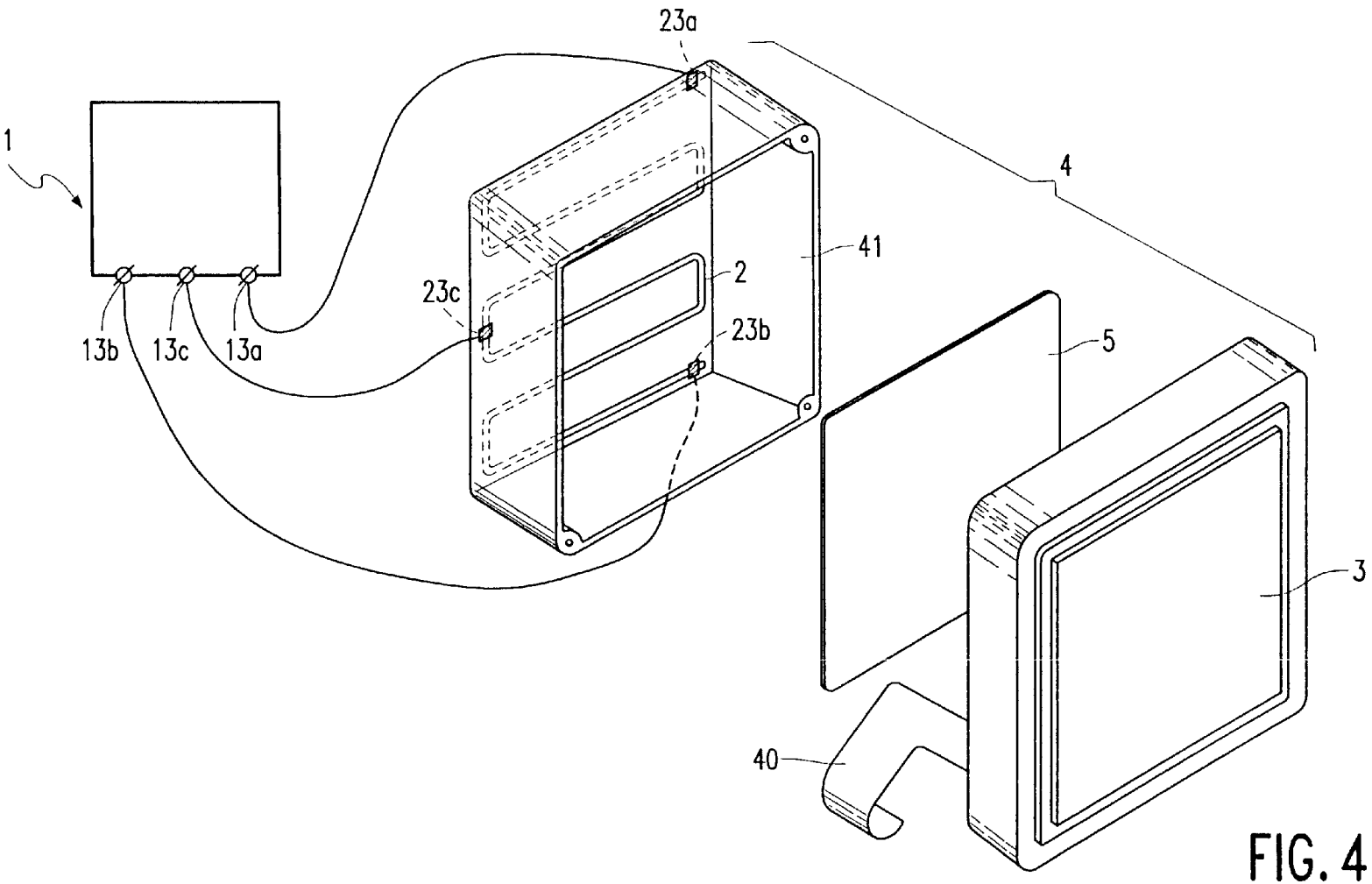

In FIG. 4, parts corresponding to parts shown in FIG. 1 have the same reference numeral. FIG. 4 schematically shows a liquid crystal display device 3 provided with an illumination unit 1, 2 in accordance with the invention. The liquid crystal display device 3 and the low-pressure discharge lamp 2 of the illumination unit together form an assembly, which is shown in an exploded view in FIG. 4. In the example shown in FIG. 4, the liquid crystal display device 3 and the low-pressure discharge lamp are jointly accommodated in a housing 4, which is provided with mounting means (not shown) and, possibly, with a support 40. The low-pressure discharge lamp 2, which is serpentine shaped, is situated in a plane which extends parallel to that in which the liquid crystal display device 3 is situated. A diffusor 5, which is supported by walls 41 of the housing, is arranged between the low-pressure discharge lamp 2 and the display device 3.

What is claimed is:

1. An illumination unit, comprising:

a high-frequency supply having a first output and a second output for supplying respective high-frequency voltages varying relative to ground, said voltages having the same magnitude and being in phase opposition, said high-frequency supply being provided with a further output which is substantially free of high-frequency voltage variations relative to ground; and a low-pressure discharge lamp having a tubular discharge vessel with opposite ends and an ionizable filling, which discharge vessel comprises a first external electrode and a second external electrode, which are arranged at respective said ends the discharge vessel and which are connected to, respectively, the first output and the second output of the supply, wherein the discharge vessel of the low-pressure discharge lamp comprises a further external electrode which is centrally arranged between the ends of the discharge vessel and which is connected to the further output of the supply.

2. An illumination unit as claimed in claim 1, wherein the supply comprises a high-frequency supply source and a transformer having a primary winding and a secondary winding, said primary winding of the transformer being connected to the high-frequency supply source, the first and the second output each being connected to an end of the secondary winding, and the further output being connected to a center tap of the secondary winding.

3. An illumination unit as claimed in claim 1, wherein the ionizable filling comprises mercury and wherein the discharge vessel has an inner surface provided with a luminescent layer.

4. An illumination unit as claimed in claim 1, wherein the discharge vessel serpentine shaped.

5. A liquid crystal display device comprising an illumination unit which comprises:

a high-frequency supply having a first output and a second output supplying respective high-frequency voltages varying relative to ground, said voltages having the same magnitude and being in phase opposition, said high-frequency supply being provided with a further output which is substantially free of high-frequency voltage variations relative to ground; and a low-pressure discharge lamp having a tubular discharge vessel with opposite ends and an ionizable filling, which discharge vessel comprises a first external electrode and a second external electrode, which are arranged on either side of the discharge vessel and which are connected to, respectively, the first output and the second output of the supply;

said discharge vessel of the low-pressure discharge lamp comprising a further external electrode which is centrally arranged between the ends of the discharge vessel and which is connected to the further output of the supply.

6. A liquid crystal display device as claimed in claim 5, wherein the supply comprises a high-frequency supply source and a transformer having a primary winding and a secondary winding, said primary winding of the transformer being connected to the high-frequency supply source, the first and the second output each being connected to an end of the secondary winding, and the further output being connected to a center tap of the secondary winding.

7. A liquid crystal display device as claimed in claim 5, wherein the ionizable filling comprises mercury and wherein the discharge vessel has an inner surface provided with a luminescent layer.

8. A liquid crystal display device as claimed in claim 5, wherein the discharge vessel is serpentine shaped.

* * * * *